US009557016B2

(12) United States Patent
Van Bommel et al.

(10) Patent No.: US 9,557,016 B2
(45) Date of Patent: Jan. 31, 2017

(54) COLOR RENDERING INDEX TUNABLE LAMP AND LUMINAIRE

(71) Applicant: PHILIPS LIGHTING HOLDING B.V., Eindhoven (NL)

(72) Inventors: Ties Van Bommel, Horst (NL); Rifat Ata Mustafa Hikmet, Eindhoven (NL)

(73) Assignee: Philips Lighting Holding B.V., Eindhoven (NL)

( * ) Notice: Subject to any disclaimer, the term of this patent is extended or adjusted under 35 U.S.C. 154(b) by 0 days.

(21) Appl. No.: 14/907,931

(22) PCT Filed: Jul. 31, 2014

(86) PCT No.: PCT/EP2014/066489
§ 371 (c)(1),
(2) Date: Jan. 27, 2016

(87) PCT Pub. No.: WO2015/014936
PCT Pub. Date: Feb. 5, 2015

(65) Prior Publication Data

US 2016/0169459 A1 Jun. 16, 2016

(30) Foreign Application Priority Data

Aug. 2, 2013 (EP) ..... 13179037

(51) Int. Cl.
*F21K 99/00* (2016.01)
*F21V 9/16* (2006.01)
(Continued)

(52) U.S. Cl.
CPC . *F21K 9/56* (2013.01); *F21K 9/64* (2016.08); *F21V 9/16* (2013.01); *F21V 23/0457* (2013.01);
(Continued)

(58) Field of Classification Search
CPC ..... F21K 9/56; F21K 9/64; F21K 9/23; F21K 99/00; F21K 2/00; F21K 9/00; F21V 9/16; F21V 23/0457; F21V 19/042; F21V 19/045; F21V 13/08; F21V 2009/00; H05B 33/0869; F21Y 2113/13; F21Y 2115/10; F21Y 2101/00; F12S 2/00; C09K 11/00; C09K 11/06; C09K 11/08; F21S 8/06; F21W 2131/10
See application file for complete search history.

(56) References Cited

U.S. PATENT DOCUMENTS 7,768,189 B2 8/2010 Radkov
8,125,137 B2 2/2012 Medendorp, Jr. et al.
(Continued)

FOREIGN PATENT DOCUMENTS

WO 20080135927 A1 11/2008
WO 2010032183 A1 3/2010
(Continued)

*Primary Examiner* — Bao Q Truong

(57) ABSTRACT

The invention provides a provides a lighting unit (100) comprising a first light source (110), a second light source (210), a first wavelength converting (1100), a second wavelength converting element (2100), wherein the lighting unit further comprises a transport infrastructure (20) configured to arrange the first light source, the second light source, the first wavelength converting element, and the second wavelength converting element in a first configuration or a second configuration by transport of one or more of these, wherein in the first configuration and the second configuration the lighting unit provides lighting unit light having substantially the same color point while having different color rendering indices. With such lighting unit, it is possible to switch between high CRI-low efficiency and low CRI-high efficiency at a given color temperature (or color point).

18 Claims, 8 Drawing Sheets

(51) Int. Cl.

| | |
|---|---|
| ***F21V 23/04*** | (2006.01) |
| ***H05B 33/08*** | (2006.01) |
| *F21S 8/06* | (2006.01) |
| *F21W 131/10* | (2006.01) |
| *F21Y 101/00* | (2016.01) |

(52) U.S. Cl.

CPC ..... *H05B 33/0869* (2013.01); *F21K 9/23* (2016.08); *F21S 8/06* (2013.01); *F21W 2131/10* (2013.01); *F21Y 2101/00* (2013.01); *F21Y 2113/13* (2016.08); *F21Y 2115/10* (2016.08)

(56) References Cited

U.S. PATENT DOCUMENTS

| | | | | |
|---|---|---|---|---|
| 8,362,695 | B2 | 1/2013 | Aanegola et al. | |
| 8,974,087 | B2 * | 3/2015 | Moeck ..... | F21S 10/02 362/277 |
| 9,097,397 | B2 * | 8/2015 | Van Stijn ..... | F21K 9/56 |
| 9,404,627 | B2 * | 8/2016 | Hikmet ..... | H01J 61/44 |
| 2011/0317398 | A1 | 12/2011 | Moeck et al. | |
| 2012/0038280 | A1 | 2/2012 | Zoorob et al. | |
| 2012/0162979 | A1 | 6/2012 | Ng et al. | |
| 2013/0120688 | A1 | 5/2013 | Chao et al. | |

FOREIGN PATENT DOCUMENTS

| | | | |
|---|---|---|---|
| WO | 2011031871 | A1 | 3/2011 |
| WO | 2012001564 | A1 | 1/2012 |
| WO | 2012095763 | A1 | 7/2012 |
| WO | 20120121304 | A1 | 9/2012 |
| WO | 2013102820 | A1 | 7/2013 |

* cited by examiner

COLOR RENDERING INDEX TUNABLE LAMP AND LUMINAIRE

CROSS-REFERENCE TO PRIOR APPLICATIONS

This application is the U.S. National Phase application under 35 U.S.C. §371 of International Application No. PCT/EP2014/066489, filed on Jul. 31, 2014, which claims the benefit of European Patent Application No. 13179037.0, filed on Aug. 2, 2013. These applications are hereby incorporated by reference herein.

FIELD OF THE INVENTION

The invention relates to a lighting unit, a luminaire comprising such lighting unit as well as to the use of such lighting unit or luminaire.

BACKGROUND OF THE INVENTION

Tunable light sources are known in the art. WO2012095763, for instance, describes a tunable white light source, comprising at least one first light emitting diode (LED) adapted to emit light of a first integrated color point, at least one second light emitting diode adapted to emit light of a second integrated color point different from said first integrated color point, wherein said first and second integrated color points are selected such that the combined light output of the first and second light emitting diodes appears white in color, and a control unit for tuning a color temperature of white light output by said tunable white light source by adjusting the relative light output between said at least one first light emitting diode and said at least one second light emitting diode, wherein the control unit is configured to restrict the color temperature of the white light output by the tunable white light source to a tunable color temperature range where both the at least one first light emitting diode and the at least one second light emitting diode emit light for all color temperatures in the tunable color temperature range.

US2011317398 describes various embodiments providing a luminous device, including at least one semiconductor light source and at least one light-transmissive converter element including a wavelength-converting phosphor sensitive to the light emitted by the semiconductor light source, wherein the semiconductor light source can be at least partly covered by the converter element, and the converter element is movable such that a proportion of a light wavelength-converted by means of the converter element is adjustable depending on a position of the converter element.

WO2012121304 describes a light-emitting device which is so adapted that the whole of light emitted from a first LED and light emitted from a second LED is allowed to enter a common fluorescent member, and that synthetic light is emitted from the common fluorescent member, wherein the synthetic light contains and is synthesized from light which is emitted from the first LED in a wavelength-converted form, light which is emitted from the second LED in a wavelength-converted from, light which is produced by the wavelength conversion by the common fluorescent member, and light and light both of which pass through the common fluorescent member without undergoing the wavelength conversion by the common fluorescent member.

WO2010135927 describes a solid-state lighting device which includes a plurality of light-emitting elements configured for generating light that are thermally coupled to a heat spreading chassis configured for coupling to one or more heat sinks. The lighting device further includes a mixing chamber which is optically coupled to the plurality of light-emitting elements and configured to mix the light emitted by the plurality of light-emitting elements. A control system is operatively coupled to the plurality of light-emitting elements, and configured to control operation of the plurality of light-emitting elements.

WO2010032183 describes a color mixing method for consistent color quality. WO2013102820 describes a color tunable lighting assembly, a light source and a luminaire. Further, US20130120688 describes a color regulating device for illumination and apparatus using the same, and a method of regulating color.

SUMMARY OF THE INVENTION

In some applications, such as outdoor lighting, it is desirable to be able to have white light close to the Black Body Line or Black Body Locus (BBL) with very high efficiency. At certain time of the day, it might be desirable to have high Color Rendering Index (CRI) while at other times high efficiency may be desired. For instance, at 9:00 pm light having a CRI preferably above 80 is desired, while at 01:00 am light with lower CRIs are still suitable while being more efficiently. For this purpose, it is interesting to have a lamp or luminaire which can switch between high CRI-low efficiency and low CRI-high efficiency at a given color temperature. In the same way, in late-stage configuration, one might like to configure the lamp to have low CRI-high efficiency by converting light to a high CRI-low efficiency lamp.

Hence, it is an aspect of the invention to provide an alternative lighting unit, which preferably further at least partly obviates one or more of above-described drawbacks and/or is able to provide one or more of the above-indicated desired properties. Especially, it is an aspect of the invention to provide a lighting unit that can switch between white light with a high CRI and white light with lower CRI (but especially more efficient (in terms of lumen $W^{-1}$). In this way, the quality of the light and the efficiency of the lighting unit can be controlled.

In order to have such a configurable lamp it is suggested in an embodiment using blue and red LEDs and use a remote/vicinity (see below) phosphor (herein also indicated as "luminescent material") for changing the emission position of the a green/yellow phosphor and adjusting the intensity of the LEDs for staying on the black body line or black body locus (BBL) at the desired color temperature and just change the emission position of the green emitter. In all cases, in order to get to a low CRI lamp it is desirable to have a dip in the blue-green part of the spectrum (especially a part of the spectrum between blue and green that has an intensity of less than about 75% of the maximum intensity at blue or green, especially less than about 50%). In general, there are two ways to get to a low CRI under the specific condition that the emission wavelength of the blue light source and the red light source does not change: (1) decrease the FWHM of a light source emitting at a wavelength between the blue and the red light source (such as a green and/or yellow light source), or (2) change the position of the peak wavelength of such light source emitting at a wavelength between the blue and the red light source and adapt the intensity of the light of the red light source accordingly. Most inorganic phosphors may have broad absorption characteristics. Here, we suggest the use of light convertors such as especially organic phosphors which absorb in blue-green part of the wavelength range to emit at longer wavelengths. It is also possible to use large stokes shift materials (examples of large stoke shift materials are described in e.g. WO2012001564). Another possibility is to use narrow band emitters such as e.g. quantum dots. However, also inorganic phosphors may be applied. Of course, also combinations of different luminescent materials may be applied. Herein the terms "phosphor" and "luminescent material" are considered to be the same (see also above).

Hence, in a first aspect the invention provides a lighting unit comprising a first light source configured to generate first light source light, a second light source configured to generate second light source light (having a spectral distribution different from the first light source light), a first wavelength converting element (herein also indicated as "first converting element" or "first converter") able to convert at least part of one or more of the first light source light and the second light source light into first wavelength converting element light, a second wavelength converting element (herein also indicated as "second converting element" or "second converter") able to convert at least part of one or more of the first light source light, the second light source light, and (optionally) the first wavelength converting element light into second wavelength converting element light having a spectral distribution different from the first wavelength converting element light, wherein the lighting unit further comprises a transport infrastructure configured to arrange the first light source, the second light source, the first wavelength converting element, and the second wavelength converting element in (at least) a first configuration or a second configuration by transport of one or more of these (light sources and converting elements), wherein in the first configuration and the second configuration the lighting unit provides lighting unit light having substantially the same color point while having different color rendering indices. With such lighting unit, it is possible to switch between high CRI-low efficiency and low CRI-high efficiency at a given color temperature (or color point) (dependent upon the first and the second configuration, respectively; note that the first configuration or the second configuration may refer to the low or high CRI configuration; these numbers are only used for the sake of reference).

The lighting unit allows (at least) a first configuration and a second configuration. However, in embodiment the lighting unit may also provide a third configuration, or optionally further configurations. Hence, the herein described lighting unit is especially configured to provide at least two different configurations (the first and the second configuration), such as at least three different configurations, wherein at least two of these configurations, even more especially all configurations of these at least two configurations provide (white) light having substantially the same color point or color temperature, but having different CRI values (and different efficiencies). Hence, phrases like "a first light source and a second light source", or "a first wavelength converting element and a second wavelength converting element", and similar phrases, may especially refer to "at least a first light source and a second light source", and "at least a first wavelength converting element and a second wavelength converting element", respectively.

As indicated above, the at least two configurations are obtainable by transport of one or more of the elements of the lighting unit, especially one or more of the first light source, the second light source, the first wavelength converting element, and the second wavelength converting element. In general, when the different configurations are obtainable by moving the first light source, also the second light source will move. Hence, in an embodiment the transport infrastructure is configured to transport at least the first light source and the second light source (to obtain the first and the second configuration, respectively). Likewise, in general when the different configurations are obtainable by moving the first converting element, also the second converting element will move. Hence, in an embodiment the transport infrastructure is configured to transport at least the first converting element and the second converting element (to obtain the first and the second configuration, respectively). Instead of the term "converting element" also the term "conversion element" might be applied.

The transport structure may especially include a manual actuation or an electronic actuation. Hence, in an embodiment the lighting unit may e.g. comprises a sliding functionality or a rotation functionality, for sliding or rotating one or more of the above-mentioned elements, respectively. Optionally, the lighting unit may further comprise an actuator, such as a hydraulic actuator, a pneumatic actuator, an electric actuator, or a mechanical actuator. A hydraulic actuator may consist of a cylinder or fluid motor that uses hydraulic power to facilitate mechanical operation. The mechanical motion gives an output in terms of linear, rotary or oscillatory motion. A pneumatic actuator may convert energy formed by compressed air at high pressure into either linear or rotary motion. Further, an electric actuator may be powered by a motor that converts electrical energy to mechanical torque. Yet, a mechanical actuator may function by converting rotary motion into linear motion to execute movement. It may involve one or more of gears, rails, pulleys, chains and other devices to operate. The actuator may (thus) include an electric motor. Control of the configurations is further discussed below, but in an embodiment, the lighting unit may be configured to manually control the configurations (or configuration setting); i.e. that manually the configuration can be chosen. This can be done in a production plant, in a distribution center or storage, in a shop, or by an end user. Optionally, the configuration is "frozen" after selection, e.g. with a kit or glue. Hence, the invention especially provides a lighting unit that is configurable with the transport structure in at least two configuration. The transport structure is especially part of the lighting unit. For instance, a single integrated unit may be provided with the transport structure being integrated in the (lighting) unit. Optionally, such lighting unit may then be fixed in a configuration. Alternatively, the end user may choose the desired configuration with the transport structure.

Hence, in an embodiment the transport structure may comprise an actuator, such as a hydraulic actuator, a pneumatic actuator, an electric actuator, or a mechanical actuator, or a combination of two or more thereof. A control unit may control the transport structure. For instance, the control unit may be configured to arrange the first light source, the second light source, the first wavelength converting element and the second wavelength converting element in the first configuration or the second configuration by instructing the actuator.

More than two configurations may optionally also be possible, for instance when there are more than two wavelength converting elements or when wavelength converting elements can be selected individually and can be arranged one downstream from the other.

In a specific embodiment, the first light source and second light source comprise a solid state LED light source (such as a LED or laser diode). However, additionally or alternatively, also Organic Light Emitting Diode (OLED) light sources may be applied. Different types of light sources may also be applied. Hence, the first light source and the second light source may independently be selected from the group consisting of a LED and a laser. The term "light source" may also relate to a plurality of light sources, such as 2-20 (solid state) (LED) light sources. Hence, the term LED may also refer to a plurality of LEDs. Of course, also more than 20 light sources may be applied. In specific embodiments, a subset of first light sources and a subset of second light sources are applied. Further, also other types of light sources may be applied, such as third light sources, fourth light sources, etc. each type having different spectral light distributions of the emitted light (see also elsewhere herein). The light sources are especially comprised by the lighting unit. The lighting unit may be incorporated in a luminaire. The term "lighting unit" may also refer to a "lamp".

The first light source and the second light source provide first light source light and second light source light, respectively. These types of light differ in spectral distributions. For instance, the first light source is configured to generate blue (first light source light) and the second light source is configured to generate red (second light source light). Hence, in an embodiment the first light source comprises a blue emitting light source, and the second light source comprises a red emitting light source. Hence, e.g. the first light source may emit blue light and the second light source may emit red light.

The terms "violet light" or "violet emission" especially relates to light having a wavelength in the range of about 380-440 nm. The terms "blue light" or "blue emission" especially relates to light having a wavelength in the range of about 440-490 nm (including some violet and cyan hues). The terms "green light" or "green emission" especially relate to light having a wavelength in the range of about 490-560 nm. The terms "yellow light" or "yellow emission" especially relate to light having a wavelength in the range of about 540-570 nm. The terms "orange light" or "orange emission" especially relate to light having a wavelength in the range of about 570-600. The terms "red light" or "red emission" especially relate to light having a wavelength in the range of about 600-800 nm. The term "pink light" or "pink emission" refers to light having a blue and a red component. The terms "visible", "visible light" or "visible emission" refer to light having a wavelength in the range of about 380-800 nm.

The lighting unit at least comprises a first wavelength converting element (herein also indicated as first converting element) and a second wavelength converting element (herein also indicated as second converting element). These converting elements or converting elements are configured to absorb light source light of at least one of the light sources and/or optionally emission light of each other, and provide emission light (first wavelength converting element light and second wavelength converting element light, respectively).

Hence, in the first configuration and the second configuration the lighting unit is configured to provide (during operation) lighting unit light, said light having (during operation in the first configuration or second configuration, respectively, substantially the same color point while having different color rendering indices. Hence, in an embodiment the lighting unit is configured to provide lighting unit light with substantially the same color point but with different color rendering indices when configured in the first configuration and the second configuration, respectively.

Especially, in a first configuration, the first light source light and optionally the second light source light, together with the first wavelength converting element light, will provide white light (lighting unit light). Further, in a second configuration, the first light source light and optionally the second light source light, together with the second wavelength converting element light, and optionally together with the first wavelength converting element light, will also provide white light (lighting unit light).

As indicated above, optionally the wavelength converting element(s) may also be able to absorb and convert conversion light of the other element, and provide thereby wavelength converting element light. Hence, especially, the first wavelength converting element (herein also indicated as first converting element) is able to convert at least part of one or more of the first light source light and the second light source light (and optionally second wavelength converting element light) into first wavelength converting element light and the second wavelength converting element (herein also indicated as second converting element) is able to convert at least part of one or more of the first light source light, the second light source light, and the first wavelength converting element light into second wavelength converting element light having a spectral distribution different from the first wavelength converting element light.

As indicated above, the emission light of the wavelength converting elements is different, i.e. they have different spectral distributions (spectral light distributions). In an embodiment, the first wavelength converting element and the second wavelength converting element each independently comprise one or more of a green luminescent material (i.e. emitting green light), a yellow luminescent material (i.e. emitting yellow light), and an orange luminescent material (i.e. emitting orange light). For instance, the first wavelength converting element may provide green light and the second wavelength converting element may provide green light with relatively more yellow light. In both configurations white light (i.e. white lighting unit light) may be generated by the lighting unit. Hence, the phrase "a first wavelength converting element able to convert at least part of one or more of the first light source light and the second light source light into first wavelength converting element light, a second wavelength converting element able to convert at least part of one or more of the first light source light, the second light source light, and the first wavelength converting element light into second wavelength converting element light having a spectral distribution different from the first wavelength converting element light" thus refers to the fact that the second wavelength converting element light has a spectral distribution different from the first wavelength converting element light.

The term white light herein, is known to the person skilled in the art. It especially relates to light having a correlated color temperature (CCT) between about 2000 and 20000 K, especially 2700-20000 K, for general lighting especially in the range of about 2700 K and 6500 K, and for backlighting purposes especially in the range of about 7000 K and 20000 K, and especially within about 15 SDCM (standard deviation of color matching) from the BBL (black body locus), especially within about 10 SDCM from the BBL, even more especially within about 5 SDCM from the BBL.

In an embodiment, the lighting unit may also provide lighting unit light having a correlated color temperature (CCT) between about 5000 and 20000 K, e.g. direct phosphor converted LEDs (blue light emitting diode with thin layer of phosphor for e.g. obtaining of 10000 K). Hence, in a specific embodiment the lighting unit is configured to provide lighting unit light with a correlated color temperature in the range of 5000-20000 K, even more especially in the range of 6000-20000 K, such as 8000-20000 K.

In both (or more) configurations, white light may be provided, having substantially the same color temperature or substantially the same color point. As is known in the art, a plurality of color combinations may provide light with the same color point. Especially, in the first configuration and in the second configuration the lighting unit provides lighting unit light having color points within 15 SDCM (standard deviation of color matching) of each other, especially within about 10 SDCM from each other, even more especially within about 5 SDCM from each other. Alternatively or additionally, substantially the same color point may also be defined as two color points of which the difference in x and y, i.e. $\Delta x$ and $\Delta y$ (of the lighting unit light in the at least two different configurations), respectively, are each independently equal to or smaller than 0.03, especially equal to or smaller than 0.02, especially equal to or smaller than 0.01, e.g. a first color point (0.35; 0.35) and a second color point (0.33; 0.37) could be considered as color points of configurations having the same color point. These 0.03, 0.02, and 0.01 values correspond to ~15 SDCM, ~10 SDCM, and ~5 SDCM, respectively, at color temperatures between about 3000 K-5000 K at the smallest diameter of the ellipse(s). Hence, especially the lighting unit is configured to provide during operation in the first configuration and in the second configuration lighting unit light, said lighting unit light having (during operation when the lighting unit is configured in the first configuration or second configuration) color points within 15 SDCM (standard deviation of color matching) of each other.

The wavelength converting elements may (each independently) include one or more of a layer of luminescent material, a luminescent material embedded in a transmissive layer, or a luminescent material molecularly dispersed in a transmissive layer. Hybrids are also possible, like luminescent materials embedded in particles, which are again embedded in a transmissive layer. The wavelength converting elements may each independently be a film, a layer, such as a self-supporting layer, or a body. The wavelength converting elements can be configured as light exit window(s) of the lighting unit. It is noted however that this may in embodiments apply for only one of the configuration. In the other configuration, the other wavelength converting element may be configured as light exit window. Hence, in such embodiments, light from the light source(s) and converter light (see further below) may emanate from the lighting unit via and from the wavelength converter (during use of the device).

The wavelength converting elements may also be configured in reflective mode. For instance, a light mixing chamber may comprise one or more wall(s) comprising the wavelength converter (reflective mode) and/or an exit window comprising the wavelength converting elements (transmissive mode). Hence, in one or more of the first configuration and the second configuration one or more of the first wavelength converting element and the second wavelength converting element are arranged in a transmissive mode.

Especially when applying a light source which is configured to produce visible light, the converter may (thus) be transmissive. In this way, e.g. blue light of the light source, assuming a light source configured to provide at least blue light, may penetrate through the converter and may be used, together with the luminescence from the converter as visible lighting unit light. When applying a light source that is configured to produce UV light, the converter may substantially be not transmissive for this UV light. The converter may especially be configured to substantially absorb all UV light that enters the converter, and substantially convert this light into luminescence. Note that the converter can thus be at the same time being substantially non-transmissive for UV light and at least partially transmissive for visible light, such as blue light.

The term "transmissive" herein may especially refer to a converter that has a light transmission in the range of 20-100%, such as 20-95%, for light having a wavelength selected from the visible wavelength range. Herein, the term "visible light" especially relates to light having a wavelength selected from the range of 380-780 nm. The transmission can be determined by providing light at a specific wavelength with a first intensity to the waveguide under perpendicular radiation and relating the intensity of the light at that wavelength measured after transmission through the material, to the first intensity of the light provided at that specific wavelength to the material (see also E-208 and E-406 of the CRC Handbook of Chemistry and Physics, 69th edition, 1088-1989). Note that the waveguide plate may be colored, due to the presence of luminescent material (see also below). The transmissiveness for UV light is especially below 10%, such as below 5%, like below 1%. The term "transmissive" may in an embodiment relate to transparent in another embodiment relate to translucent.

The converter may have any shape, such as a layer or a self-supporting body. It may be flat, curved, shaped, squared, round hexagonal, spherical tubular, cubic, etc. The self-supporting body may be rigid or flexible. The thickness may in general be in the range of 0.1-10 mm. The length and/or width (or diameter) may be in the range of for instance 0.01-5 m, such as 0.02-5 m, for instance 0.1-50 mm. The converter may be a layer, for instance coated to a transmissive support; however, in general the converter will be a shaped (flexible) body. The converter may (thus) also be self-supporting, and for instance be a plate or a (flexible) entity.

The term "matrix" is used herein to indicate a layer or body or shaped article, etc., which hosts another material, such as a (particulate) luminescent material.

The matrix (material) may comprises one or more materials selected from the group consisting of a transmissive organic material support, such as selected from the group consisting of PE (polyethylene), PP (polypropylene), PEN (polyethylene naphthalate), PC (polycarbonate), polymethylacrylate (PMA), polymethylmethacrylate (PMMA) (Plexiglas or Perspex), cellulose acetate butyrate (CAB), silicone, polyvinylchloride (PVC), polyethyleneterephthalate (PET), (PETG) (glycol modified polyethyleneterephthalate), PDMS (polydimethylsiloxane), and COC (cyclo olefin copolymer). However, in another embodiment the matrix (material) may comprise an inorganic material. Preferred inorganic materials are selected from the group consisting of glasses, (fused) quartz, transmissive ceramic materials, and silicones. Also hybrid materials, comprising both inorganic and organic parts may be applied. Especially preferred are PMMA, PET, transparent PC, or glass as material for the matrix (material). Even more especially, the matrix comprises polyethylene terephthalate (PET).

The wavelength converting element(s) is (are) radiationally coupled to the light source (or, as indicated above, a plurality of light sources). The term "radiationally coupled" especially means that the light source and the wavelength converting elements are associated with each other so that at least part of the radiation emitted by the light source is received by the wavelength converting elements (and at least partly converted into luminescence), at least in one of the configurations. Again, this may especially refer for one of the wavelength converting elements in the first configuration and for the other wavelength converting element in the second configuration, etc. The term "luminescence" refers to the emission which emits the wavelength converting elements emit upon excitation by the light source light of the light source. This luminescence is herein also indicated as converter light (which at least comprises visible light, see also below).

The terms "upstream" and "downstream" relate to an arrangement of items or features relative to the propagation of the light from a light generating means (here the especially the first light source or the second light source), wherein relative to a first position within a beam of light from the light generating means, a second position in the beam of light closer to the light generating means is "upstream", and a third position within the beam of light further away from the light generating means is "downstream".

The emission light from the wavelength converting elements, upon excitation with light of e.g. one or more of the first and the second light source, is especially due to a luminescent material. The term "luminescent material" may also relate to a plurality of luminescent materials (see also above). The term "luminescent material" may also relate to a mixture or combination of different luminescent materials. In the lighting device, at least two different luminescent materials may be applied, as each (of the at least two) wavelength converting element(s) has its own specific spectral light distribution (of the emission). Note that in principle identical types of luminescent materials with different activator concentrations may already lead to different luminescent materials, as such materials may have different luminescence spectra. Hence, each light converting element may comprise one or more (different) luminescent materials. The one or more luminescent materials are (each independently) especially selected from the group consisting of quantum dot luminescent materials, inorganic luminescent materials and organic luminescent materials. A combination of different types of luminescent materials may also be applied (both in the first and the second light converting elements). Hence, the term conversion may especially refer to the conversion of excitation light into luminescence (or emission) light by a luminescent material. The wavelength converting elements especially comprise at least one luminescent material.

Especially, the lighting unit comprises a luminescent material that absorbs in the blue-green, especially absorbing at a wavelength selected from the range of 490-520 nm.

Relevant examples of organic luminescent materials (that may independently be used as first and second luminescent material) are e.g. perylenes (such as luminescent materials known under their trade name Lumogen from the company BASF, Ludwigshafen, Germany: Lumogen F240 Orange, Lumogen F300 Red Lumogen F305 Red, Lumogen F083 Yellow, Lumogen F170 Yellow, Lumogen F850 Green), Yellow 172 from the company Neelikon Food Dyes & Chemical Ltd., Mumbai, India, India, and luminescent materials such as coumarins (for example Coumarin 6, Coumarin 7, Coumarin 30, Coumarin 153, Basic Yellow 51), napthalimides (for example Solvent Yellow 11, Solvent Yellow 116), Fluorol 7GA, pyridines (for example pyridine 1), pyrromethenes (such as Pyrromethene 546, Pyrromethene 567), uranine, rhodamines (for example Rhodamine 110, Rhodamine B, Rhodamine 6G, Rhodamine 3B, Rhodamine 101, Sulphorhodamine 101, Sulphorhodamine 640, Basic Violet 11, Basic Red 2), cyanines (for example phthalocyanine, DCM), stilbenes (for example Bis-MSB, DPS), available from many traders. Several other luminescent materials, such as acid dyes, basic dyes, direct dyes and dispersion dyes may be used as long as they show a sufficiently high fluorescence quantum yield for the intended use. Organic materials of special interest that may be applied comprise for instance BASF Lumogen 850 for green luminescence, BASF Lumogen F083 or F170 for yellow luminescence, BASF Lumogen F 240 for orange luminescence, and BASF Lumogen F 300 or F305 for red luminescence. Hence, the luminescent materials may comprise for instance at least two of the above-mentioned organic luminescent materials, and optionally one or more further organic luminescent materials, which may also be selected from the above-mentioned organic luminescent materials.

Some specific inorganic luminescent materials (that may independently be used as first and second luminescent material) are discussed hereafter.

Several options for green emitters are possible, including one or more of $(Ca,Sr,Ba)(Al,Ga,In)_2(O,S,Se)_4:Eu^{2+}$, a thiogallate, especially such luminescent material at least comprising Sr, Ga and S, such as $SrGa_2S_4:Eu^{2+}$. These types of luminescent materials may especially be narrow band green emitters.

Optionally or alternatively, the inorganic luminescent material may comprise a $M_3A_5O_{12}:Ce^{3+}$ (garnet material), wherein M is selected from the group consisting of Sc, Y, Tb, Gd, and Lu, wherein A is selected from the group consisting of Al and Ga. Preferably, M at least comprises one or more of Y and Lu, and wherein A at least comprises Al. These types of materials may give highest efficiencies. Embodiments of garnets especially include $M_3A_5O_{12}$ garnets, wherein M comprises at least yttrium or lutetium and wherein A comprises at least aluminum. Such garnet may be doped with cerium (Ce), with praseodymium (Pr) or a combination of cerium and praseodymium; especially however with at least Ce. Especially, A comprises aluminum (Al), however, A may also partly comprise gallium (Ga) and/or scandium (Sc) and/or indium (In), especially up to about 20% of Al, more especially up to about 10% of Al (i.e. the A ions essentially consist of 90 or more mole % of Al and 10 or less mole % of one or more of Ga, Sc and In); A may especially comprise up to about 10% gallium. In another variant, A and O may at least partly be replaced by Si and N. The element M may especially be selected from the group consisting of yttrium (Y), gadolinium (Gd), terbium (Tb) and lutetium (Lu). Further, Gd and/or Tb are especially only present up to an amount of about 20% of M. In a specific embodiment, the garnet luminescent material comprises $(Y_{1-x}Lu_x)_3Al_5O_{12}:Ce$, wherein x is equal to or larger than 0 and equal to or smaller than 1. The term ":Ce" or ":$Ce^{3+}$", indicates that part of the metal ions (i.e. in the garnets: part of the "M" ions) in the luminescent material is replaced by Ce. Especially a lutetium comprising garnet may provide the desired luminescence, especially when lutetium is at least 50% of M.

Additionally or alternatively, the inorganic luminescent material may also comprise a luminescent material selected from the group consisting of divalent europium containing nitride luminescent material or a divalent europium containing oxonitride luminescent material, such as one or more materials selected from the group consisting of (Ba,Sr,Ca)S:Eu, $(Mg,Sr,Ca)AlSiN_3:Eu$ and $(Ba,Sr,Ca)_2Si_5N_8:Eu$. In these compounds, europium (Eu) is substantially or only divalent, and replaces one or more of the indicated divalent cations. In general, Eu will not be present in amounts larger than 10% of the cation, especially in the range of about 0.5-10%, more especially in the range of about 0.5-5% relative to the cation(s) it replaces. The term ":Eu" or ":$Eu^{2+}$", indicates that part of the metal ions is replaced by Eu (in these examples by $Eu^{2+}$). For instance, assuming 2% Eu in $CaAlSiN_3$:Eu, the correct formula could be $(Ca_{0.98}Eu_{0.02})AlSiN_3$. Divalent europium will in general replace divalent cations, such as the above divalent alkaline earth cations, especially Ca, Sr or Ba. The material (Ba,Sr,Ca)S:Eu can also be indicated as MS:Eu, wherein M is one or more elements selected from the group consisting of barium (Ba), strontium (Sr) and calcium (Ca); especially, M comprises in this compound calcium or strontium, or calcium and strontium, more especially calcium. Here, Eu is introduced and replaces at least part of M (i.e. one or more of Ba, Sr, and Ca). Further, the material $(Ba,Sr,Ca)_2Si_5N_8$:Eu can also be indicated as $M_2Si_5N_8$:Eu, wherein M is one or more elements selected from the group consisting of barium (Ba), strontium (Sr) and calcium (Ca); especially, M comprises in this compound Sr and/or Ba. In a further specific embodiment, M consists of Sr and/or Ba (not taking into account the presence of Eu), especially 50-100%, especially 50-90% Ba and 50-0%, especially 50-10% Sr, such as $Ba_{1.5}Sr_{0.5}Si_5N_8$:Eu, (i.e. 75% Ba; 25% Sr). Here, Eu is introduced and replaces at least part of M i.e. one or more of Ba, Sr, and Ca). Likewise, the material $(Ba,Sr,Ca)AlSiN_3$:Eu can also be indicated as $MAlSiN_3$:Eu wherein M is one or more elements selected from the group consisting of barium $(Ba)_5$ strontium (Sr) and calcium (Ca); especially, M comprises in this compound calcium or strontium, or calcium and strontium, more especially calcium. Here, Eu is introduced and replaces at least part of M (i.e. one or more of Ba, Sr, and Ca). Preferably, in an embodiment the inorganic luminescent material comprises (Ca,Sr,Mg) $AlSiN_3$:Eu, preferably $CaAlSiN_3$:Eu. Further, in another embodiment, which may be combined with the former, the inorganic luminescent material comprises $(Ca,Sr,Ba)_2Si_5N_8$:Eu, preferably $(Sr,Ba)_2Si_5N_8$:Eu. The terms "(Ca,Sr,Ba)" indicate that the corresponding cation may be occupied by calcium, strontium or barium. It also indicates that in such material corresponding cation sites may be occupied with cations selected from the group consisting of calcium, strontium and barium. Thus, the material may for instance comprise calcium and strontium, or only strontium, etc.

The inorganic luminescent material may also comprise one or more luminescent materials selected from the group consisting of a trivalent cerium containing garnet (see above) and a trivalent cerium containing oxonitride. The oxonitride materials are in the art often also indicated as oxynitride materials.

The term "inorganic luminescent material" may thus also relate to a plurality of different inorganic luminescent materials. The inorganic luminescent material may be comprised by the light converter, such as embedded in the matrix, like especially the organic luminescent material, or may be outside the light converter, such as a layer on the light converter, or may be elsewhere in the lighting device. Combinations of two or more of such configurations are also possible (see also above). Hence, in an embodiment the inorganic luminescent material, such as the quantum dot based luminescent material, is embedded in the matrix.

Additionally or alternatively, the inorganic luminescent material may comprise quantum Dots (QDs). Amongst other narrow band emitters quantum dots are highly suitable for this purpose. Quantum dots are small crystals of semiconducting material generally having a width or diameter of only a few nanometers. When excited by incident light, a quantum dot emits light of a color determined by the size and material of the crystal. Light of a particular color can therefore be produced by adapting the size of the dots. This means that by using quantum dots any spectrum can be obtained as they are narrow band emitters.

Most known quantum dots with emission in the visible range are based on cadmium selenide (CdSe) with shell such as cadmium sulfide (CdS) and zinc sulfide (ZnS). Cadmium free quantum dots such as indium phosphide (InP), and copper indium sulfide (CuInS2) and/or silver indium sulfide ($AgInS_2$) can also be used. Quantum dots show very narrow emission band and thus they show saturated colors. Furthermore, the emission color can easily be tuned by adapting the size of the quantum dots.

The quantum dots or luminescent nanoparticles, which are herein indicated as light converter nanoparticles, may for instance comprise group II-VI compound semiconductor quantum dots selected from the group consisting of CdS, CdSe, CdTe, ZnS, ZnSe, ZnTe, HgS, HgSe, HgTe, CdSeS, CdSeTe, CdSTe, ZnSeS, ZnSeTe, ZnSTe, HgSeS, HgSeTe, HgSTe, CdZnS, CdZnSe, CdZnTe, CdHgS, CdHgSe, CdHgTe, HgZnS, HgZnSe, HgZnTe, CdZnSeS, CdZnSeTe, CdZnSTe, CdHgSeS, CdHgSeTe, CdHgSTe, HgZnSeS, HgZnSeTe and HgZnSTe. In another embodiment, the luminescent nanoparticles may for instance be group III-V compound semiconductor quantum dots selected from the group consisting of GaN, GaP, GaAs, AlN, AlP, AlAs, InN, InP, InAs, GaNP, GaNAs, GaPAs, AlNP, AlNAs, AlPAs, InNP, InNAs, InPAs, GaAlNP, GaAlNAs, GaAlPAs, GaInNP, GaInNAs, GaInPAs, InAlNP, InAlNAs, and InAlPAs. In yet a further embodiment, the luminescent nanoparticles may for instance be I-III-VI2 chalcopyrite-type semiconductor quantum dots selected from the group consisting of $CuInS_2$, $CuInSe_2$, $CuGaS_2$, $CuGaSe_2$, $AgInS_2$, $AgInSe_2$, $AgGaS_2$, and $AgGaSe_2$. In yet a further embodiment, the luminescent nanoparticles may for instance be I-V-VI2 semiconductor quantum dots, such as selected from the group consisting of $LiAsSe_2$, $NaAsSe_2$ and $KAsSe_2$. In yet a further embodiment, the luminescent nanoparticles may for instance be a group IV-VI compound semiconductor nano crystals such as SbTe. In a specific embodiment, the luminescent nanoparticles are selected from the group consisting of InP, $CuInS_2$, $CuInSe_2$, CdTe, CdSe, CdSeTe, $AgInS_2$ and $AgInSe_2$. In yet a further embodiment, the luminescent nanoparticles may for instance be one of the group II-VI, III-V, I-III-V and IV-VI compound semiconductor nano crystals selected from the materials described above with inside dopants such as ZnSe:Mn, ZnS:Mn. The dopant elements could be selected from Mn, Ag, Zn, Eu, S, P, Cu, Ce, Tb, Au, Pb, Tb, Sb, Sn and Tl. Herein, the luminescent nanoparticles based luminescent material may also comprise different types of QDs, such as CdSe and ZnSe:Mn.

It appears to be especially advantageous to use II-VI quantum dots. Hence, in an embodiment the semiconductor based luminescent quantum dots comprise II-VI quantum dots, especially selected from the group consisting of CdS, CdSe, CdTe, ZnS, ZnSe, ZnTe, HgS, HgSe, HgTe, CdSeS, CdSeTe, CdSTe, ZnSeS, ZnSeTe, ZnSTe, HgSeS, HgSeTe, HgSTe, CdZnS, CdZnSe, CdZnTe, CdHgS, CdHgSe, CdHgTe, HgZnS, HgZnSe, HgZnTe, CdZnSeS, CdZnSeTe, CdZnSTe, CdHgSeS, CdHgSeTe, CdHgSTe, HgZnSeS, HgZnSeTe and HgZnSTe, even more especially selected from the group consisting of CdS, CdSe, CdSe/CdS and CdSe/CdS/ZnS.

In an embodiment, Cd-free QDs are applied. In a specific embodiment, the light converter nano-particles comprise III-V QDs, more specifically an InP based quantum dots, such as a core-shell InP—ZnS QDs. Note that the terms "InP quantum dot" or "InP based quantum dot" and similar terms may relate to "bare" InP QDs, but also to core-shell InP QDs, with a shell on the InP core, such as a core-shell InP—ZnS QDs, like a InP—ZnS QDs dot-in-rod.

Typical dots are made of binary alloys such as cadmium selenide, cadmium sulfide, indium arsenide, and indium phosphide. However, dots may also be made from ternary alloys such as cadmium selenide sulfide. These quantum dots can contain as few as 100 to 100,000 atoms within the quantum dot volume, with a diameter of 10 to 50 atoms. This corresponds to about 2 to 10 nanometers. For instance, spherical particles such as CdSe, InP, or $CuInSe_2$, with a diameter of about 3 nm may be provided. The luminescent nanoparticles (without coating) may have the shape of spherical, cube, rods, wires, disk, multi-pods, etc., with the size in one dimension of less than 10 nm. For instance, nanorods of CdSe with the length of 20 nm and a diameter of 4 nm may be provided. Hence, in an embodiment the semiconductor based luminescent quantum dots comprise core-shell quantum dots. In yet another embodiment, the semiconductor based luminescent quantum dots comprise dots-in-rods nanoparticles. A combination of different types of particles may also be applied. For instance, core-shell particles and dots-in-rods may be applied and/or combinations of two or more of the afore-mentioned nano particles may be applied, such as CdS and CdSe. Here, the term "different types" may relate to different geometries as well as to different types of semiconductor luminescent material. Hence, a combination of two or more of (the above indicated) quantum dots or luminescent nano-particles may also be applied.

One example, such as derived from WO 2011/031871, of a method of manufacturing a semiconductor nanocrystal is a colloidal growth process.

In an embodiment, nanoparticles can comprise semiconductor nanocrystals including a core comprising a first semiconductor material and a shell comprising a second semiconductor material, wherein the shell is disposed over at least a portion of a surface of the core. A semiconductor nanocrystal including a core and shell is also referred to as a "core/shell" semiconductor nanocrystal.

For example, the semiconductor nanocrystal can include a core having the formula MX, where M can be cadmium, zinc, magnesium, mercury, aluminum, gallium, indium, thallium, or mixtures thereof, and X can be oxygen, sulfur, selenium, tellurium, nitrogen, phosphorus, arsenic, antimony, or mixtures thereof. Examples of materials suitable for use as semiconductor nanocrystal cores include, but are not limited to, ZnO, ZnS, ZnSe, ZnTe, CdO, CdS, CdSe, CdTe, MgS, MgSe, GaAs, GaN, GaP, GaSe, GaSb, HgO, HgS, HgSe, HgTe, InAs, InN, InP, InSb, AlAs, AlN, AlP, AlSb, TlN, TlP, TlAs, TlSb, PbO, PbS, PbSe, PbTe, Ge, Si, an alloy including any of the foregoing, and/or a mixture including any of the foregoing, including ternary and quaternary mixtures or alloys.

The shell can be a semiconductor material having a composition that is the same as or different from the composition of the core. The shell comprises an overcoat of a semiconductor material on a surface of the core semiconductor nanocrystal can include a Group IV element, a Group II-VI compound, a Group II-V compound, a Group III-VI compound, a Group III-V compound, a Group IV-VI compound, a Group I-III-VI compound, a Group II-IV-VI compound, a Group II-IV-V compound, alloys including any of the foregoing, and/or mixtures including any of the foregoing, including ternary and quaternary mixtures or alloys. Examples include, but are not limited to, ZnO, ZnS, ZnSe, ZnTe, CdO, CdS, CdSe, CdTe, MgS, MgSe, GaAs, GaN, GaP, GaSe, GaSb, HgO, HgS, HgSe, HgTe, InAs, InN, InP, InSb, AlAs, AlN, AlP, AlSb, TlN, TlP, TlAs, TlSb, PbO, PbS, PbSe, PbTe, Ge, Si, an alloy including any of the foregoing, and/or a mixture including any of the foregoing. For example, ZnS, ZnSe or CdS overcoatings can be grown on CdSe or CdTe semiconductor nanocrystals.

Examples of semiconductor nanocrystal (core)shell materials include, without limitation: red (e.g., (CdSe)ZnS (core) shell), green (e.g., (CdZnSe)CdZnS (core)shell, etc.), and blue (e.g., (CdS)CdZnS (core)shell (see further also above for examples of specific light converter nanoparticles, based on semiconductors.

Therefore, in a specific embodiment, the light converter nanoparticles are selected from the group consisting of core-shell nano particles, with the cores and shells comprising one or more of CdS, CdSe, CdTe, ZnS, ZnSe, ZnTe, HgS, HgSe, HgTe, CdSeS, CdSeTe, CdSTe, ZnSeS, ZnSeTe, ZnSTe, HgSeS, HgSeTe, HgSTe, CdZnS, CdZnSe, CdZnTe, CdHgS, CdHgSe, CdHgTe, HgZnS, HgZnSe, HgZnTe, CdZnSeS, CdZnSeTe, CdZnSTe, CdHgSeS, CdHgSeTe, CdHgSTe, HgZnSeS, HgZnSeTe, HgZnSTe, GaN, GaP, GaAs, AlN, AlP, AlAs, InN, InP, InAs, GaNP, GaNAs, GaPAs, AlNP, AlNAs, AlPAs, InNP, InNAs, InPAs, GaAlNP, GaAlNAs, GaAlPAs, GaInNP, GaInNAs, GaInPAs, InAlNP, InAlNAs, and InAlPAs.

In general, the cores and shells comprise the same class of material, but essentially consist of different materials, like a ZnS shell surrounding a CdSe core, etc.

When switching from the first configuration to the second configuration, it may be necessary to fine tune the color point to arrive at the desired (predetermined) color point. This may especially be done by tuning the intensity of one or more of the first and the second light source. Assuming for instance a blue first light source and a red second light source, the intensity of red light source may be tuned to keep both configurations close to the BBL (and close to each other's color point). Hence, in an embodiment one or more of the first light source and the second light source have a tunable light intensity, and the lighting unit further comprises a control unit configured to control the tunable light intensity of the one or more of the first light source and the second light source having a tunable light intensity as function of the first and the second configuration. The control unit may for instance control the intensity of the light source light of one or more of the light sources as function of the configuration based on predetermined settings. Alternatively or additionally, the control unit may control the intensity of the light source light of one or more of the light sources as function of an optical sensor signal, of an optical sensor that may especially be configured to measure the lighting unit light. Based on the optical sensor signal, the control unit may fine tune the color point (of the lighting unit light) and optionally also one or more of the CRI and efficiency (by controlling the intensity of one or more of the first and the second light source). Hence, in an embodiment, the lighting unit may further comprise an optical sensor, wherein the control unit is configured to control the tunable light intensity of the one or more of the first light source and the second light source having a tunable light intensity as function of a sensor signal of the optical sensor. The term "optical sensor" may also refer to a plurality of optical sensors. The optical sensor may include a sensor configured to measure a color point of light or a sensor configured to measure a spectral light distribution, etc.

A plurality of configurations are possible to obtain the first configuration and the second configuration. One may think of wavelength converting elements next to each other, downstream of each other, etc. In a specific embodiment, the first and the second configuration are obtained by placing one of the wavelength converting elements in front of the other in a first configuration, and not in front of each other in a second configuration. In the latter configuration, the light source(s) together with the first or the second wavelength converting element may provide the lighting unit light. Hence, in an embodiment the transport infrastructure is configured to arrange in a first configuration the first wavelength converting element downstream of the first light source and the second light source and in a second configuration the first wavelength converting element and the second wavelength converting element in a (stacked) configuration downstream of the first light source and the second light source. However, in yet another embodiment, which may optionally be combined with the former embodiment, the transport infrastructure is configured to arrange in a first configuration the first wavelength converting element downstream of the first light source and the second light source and in a second configuration the second wavelength converting element in a stacked configuration downstream of the first light source and the second light source.

As indicated above, the lighting unit may comprise two or more light converting elements. For instance, the first light converting element may in an embodiment comprise a stack of light converting elements. Likewise, in another embodiment, that may be combined with the former embodiment, the second light converting element may in an embodiment comprise a stack of light converting elements.

Optionally, in a stacked configuration there may be a non-zero distance between adjacent converting elements.

Alternatively or additionally, not only two configurations may be allowed, but also more than two configurations may be provided by the lighting device. Hence, in an embodiment the lighting unit comprises a plurality of wavelength converting elements, wherein the transport infrastructure is configured to arrange the first light source, the second light source, and the plurality of wavelength converting element in a plurality of configurations, by transport of one or more of these, wherein at least in the first configuration and the second configuration the lighting unit provides lighting unit light having substantially the same color point while having different color rendering indices.

The lighting unit may be used for all kind of applications. For instance, the lighting unit may be applied for outdoor lighting, such as stadium lighting, road lighting, flashlights, or for vehicle lighting such as bicycle lamps or automotive lighting, or for indoor lighting such as retail lighting, office lighting or home lighting, etc. Hence, it may also be advantageous to include a sensor that may sense (outdoor) parameters, like one or more of fog, haze, temperature, rain, snow, dark, light, height of the sun, etc. Therefore, in an embodiment, the lighting unit further comprises a sensor configured to sense a condition external from the lighting unit, wherein the lighting unit further comprises a control unit configured to control the lighting unit light as function of a sensor signal of the sensor.

The invention also provides a luminaire comprising the lighting unit as defined herein, such as a street lamp/luminaire or a stadium lamp/luminaire. The lighting unit or the luminaire may for instance be used for providing white light that has a controllable color rendering. The lighting unit or the luminaire may for instance also be used for controlling efficiency and adapting lighting properties as function of the demand. Especially, as indicated above, the lighting unit or the luminaire may for instance be used for outdoor lighting. However, the lighting unit may also be part of or may be applied in e.g. office lighting systems, household application systems, shop lighting systems, home lighting systems, accent lighting systems, spot lighting systems, theater lighting systems, fiber-optics application systems, projection systems, self-lit display systems, pixelated display systems, segmented display systems, warning sign systems, medical lighting application systems, indicator sign systems, decorative lighting systems, portable systems, automotive applications, green house lighting systems, horticulture lighting, or LCD backlighting.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying (schematic) drawings in which corresponding reference symbols indicate corresponding parts, and in which.

The drawings are not necessarily on scale.

Figure 4A:
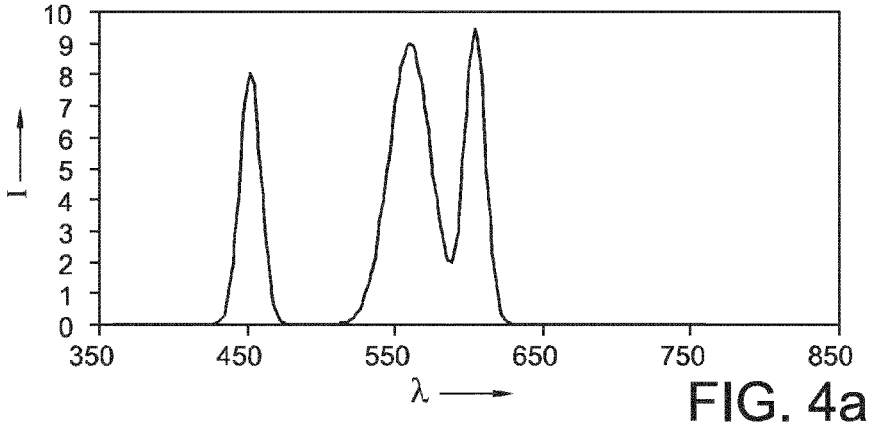
Figure 4B:
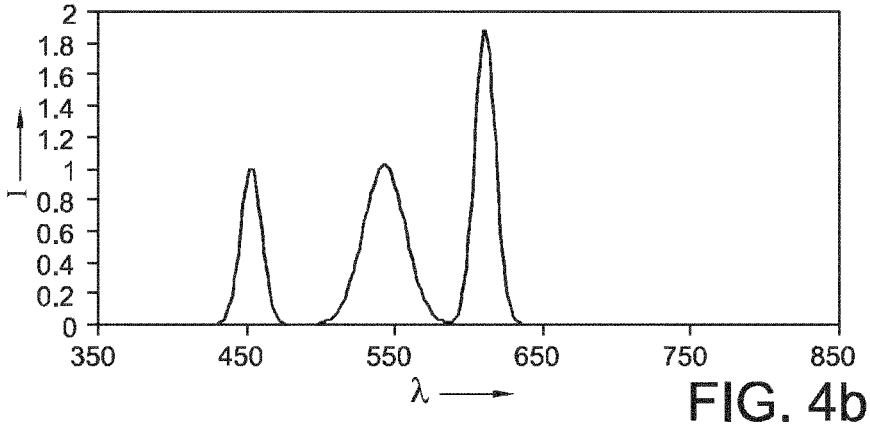
Figure 4C:
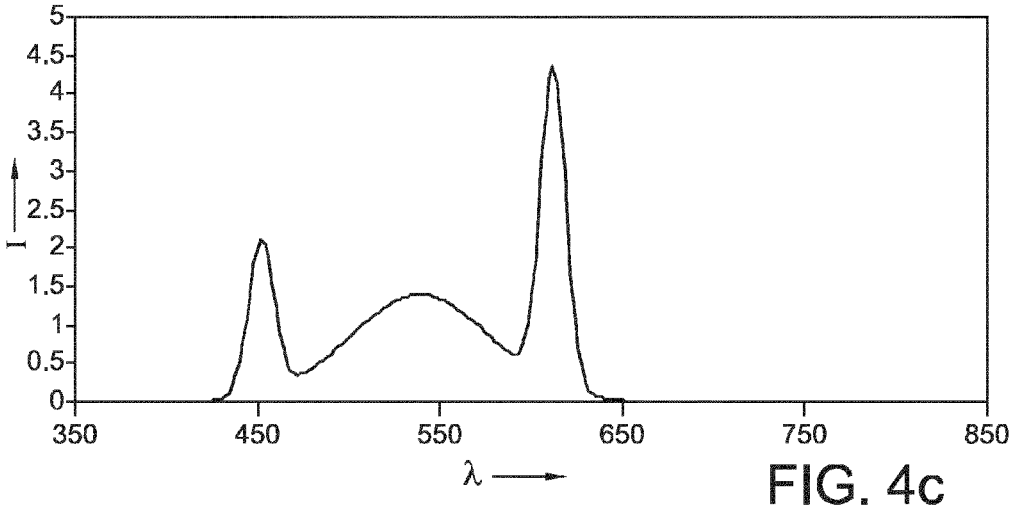
Figure 5A:
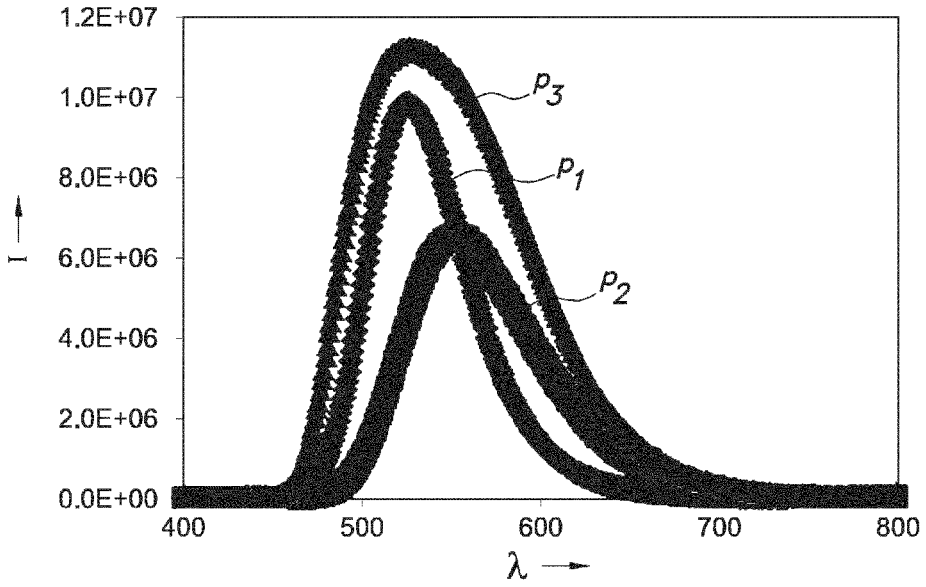
Figure 5B:
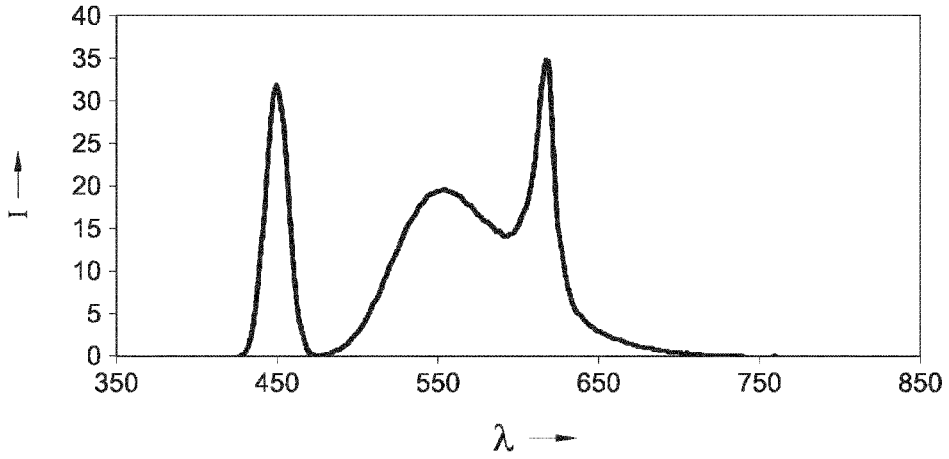
Figure 5C:
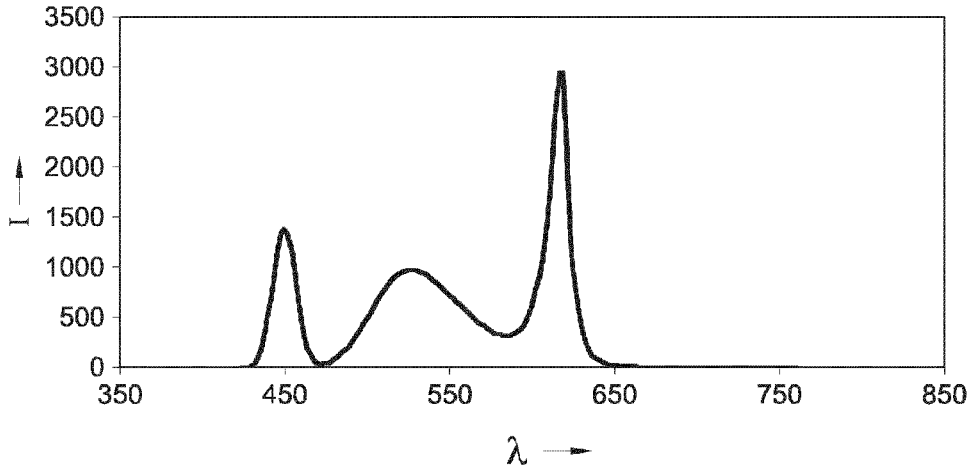
Figure 5D:
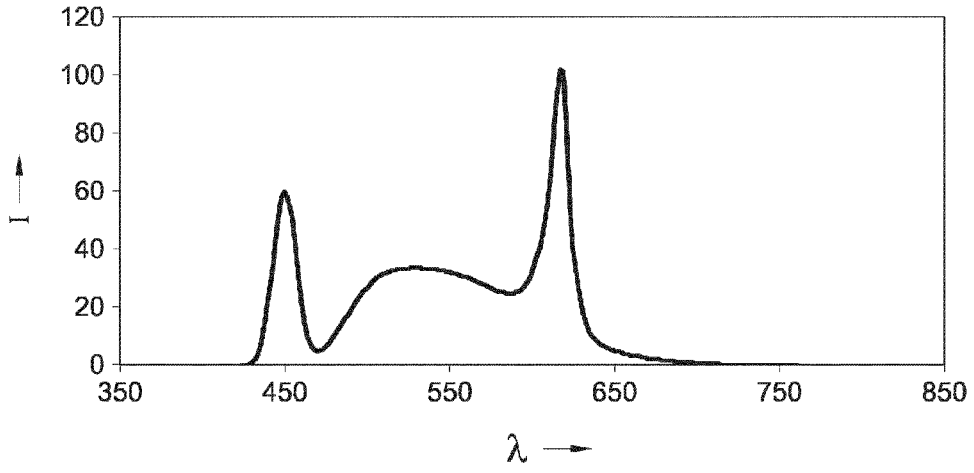

FIGS. 4*a*-4*d* depict different emission spectra of different combinations of light sources and luminescent materials, all leading to the same color point;

FIGS. 5*a*-5*d* depict emission spectra of different phosphors (P1, P2 and P3) (FIG. 5*a*) and different emission spectra of different combinations of light sources and luminescent materials, all leading to the same color point (FIGS. 5*b*-5*d*). On the x-axis of FIGS. 4*a*-4*c* and 5*a*-5*d* the wavelength in nanometers is indicated; on the y-axis the intensity in arbitrary units.

DETAILED DESCRIPTION OF THE EMBODIMENTS

FIG. 1 schematically depicts a lighting unit 100 comprising a first light source 110 configured to generate first light source light 111, a second light source 210 configured to generate second light source light 211. The second light source light 211 has a spectral distribution different from the first light source light 111, such as blue and red light, respectively. For instance, the blue light source may emit blue light in the range of 400 to 500 nm, especially 440-490 nm, and the red light source emits red light in the range of 600 to 800 nm.

Further, the lighting unit comprises a first wavelength converting element 1100 able to convert at least part of one or more of the first light source light 111 and the second light source light 211 into first wavelength converting element light 1101. Here, in this configuration the first wavelength converting element 1100 is configured downstream of the first light source 110 and the second light source 210, and will thus generate first wavelength converting element light 1101 based on conversion of one or more of the first light source light 111 and the second light source light 211.

In general (i.e. not limited to this specific schematically depicted embodiment), only light of one of the light sources will be converted, as the light of the other light source may be used to tune the color point.

Figure 1A:
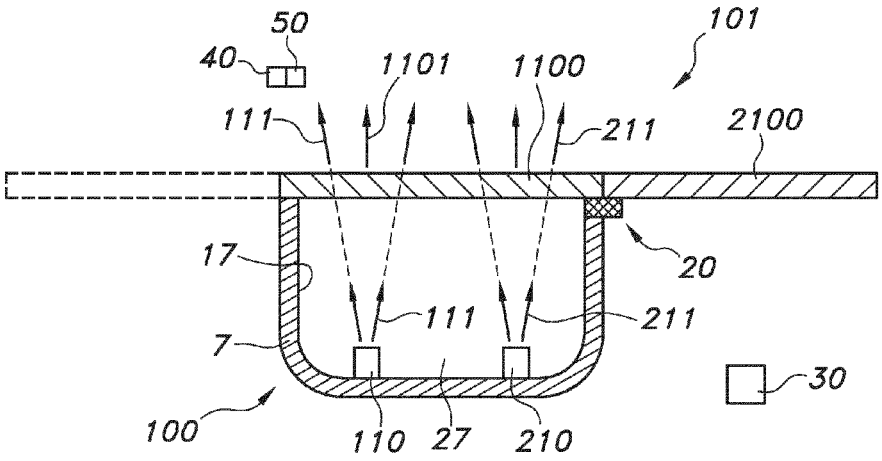
FIGS. 1*a*-1*c* schematically depict some aspects of the invention.
Figure 2A:
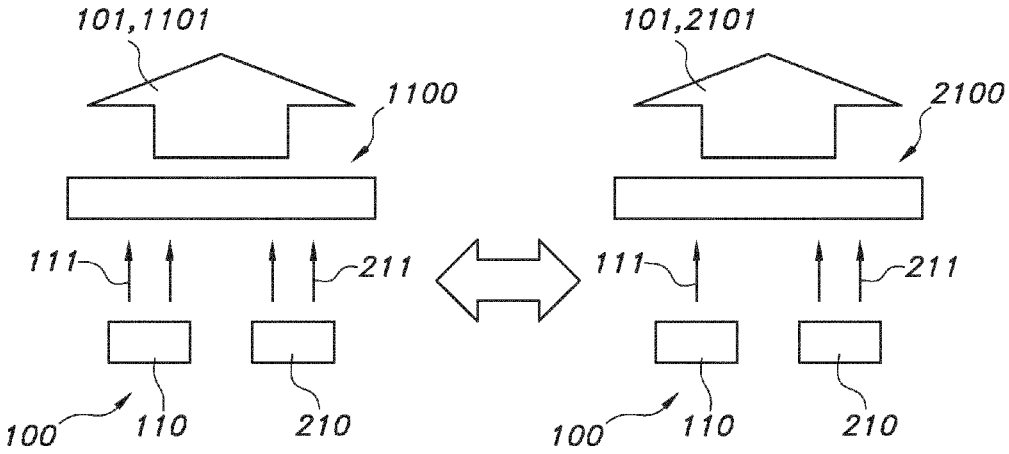
FIGS. 2*a*-2*f* schematically depicts some embodiments and configurations.
Figure 2B:
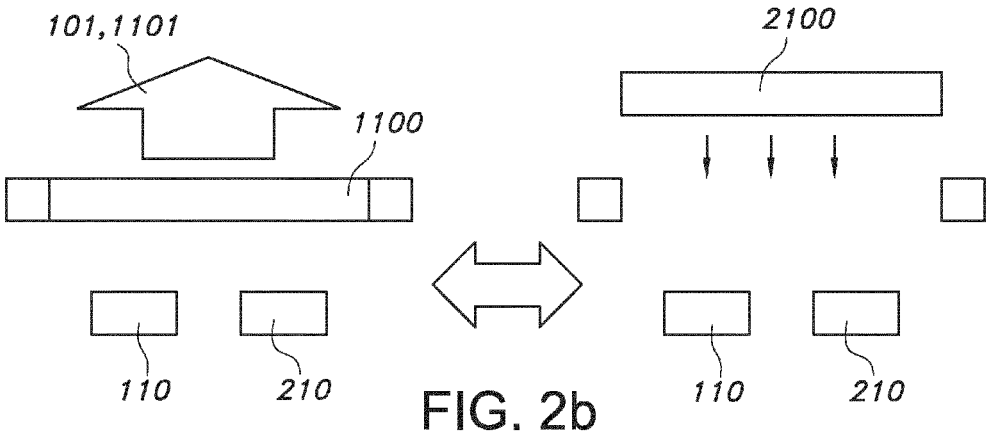
Figure 2C:
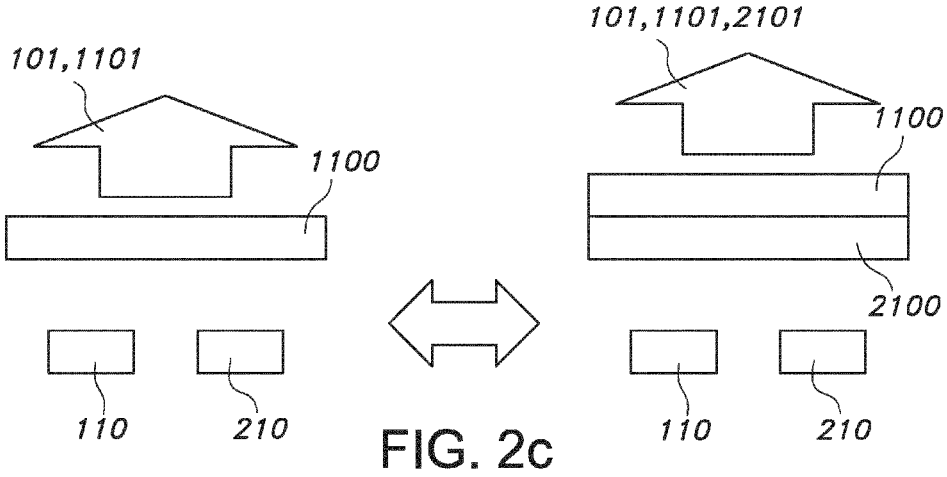
Figure 2D:
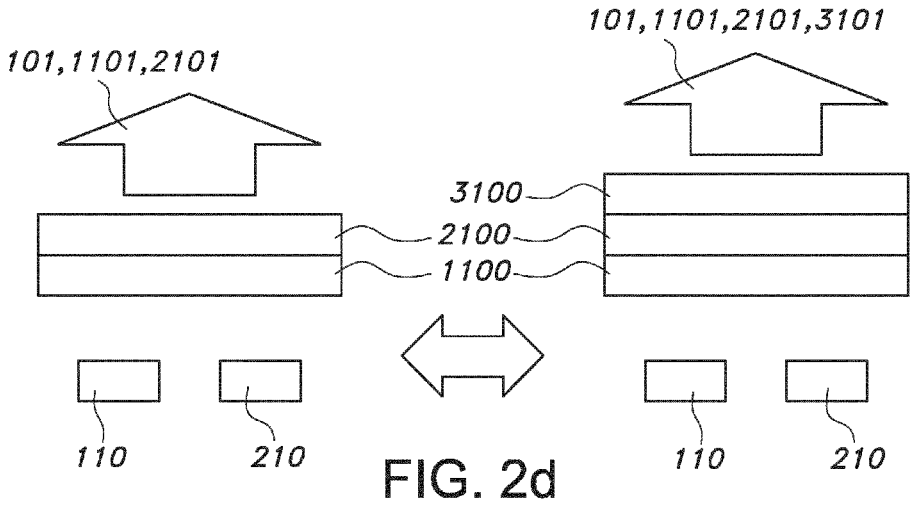
Figure 2E:
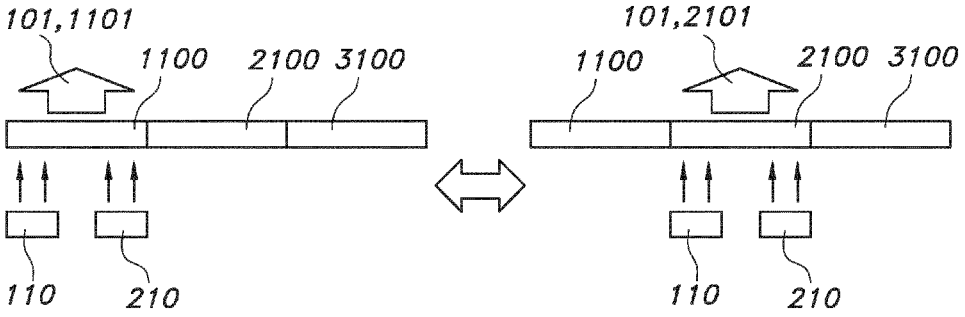

Further, the lighting unit 100 comprises a second wavelength converting element 2100 able to convert at least part of one or more of the first light source light 111, the second light source light 211, and the first wavelength converting element light 1101 into second wavelength converting element light 2101 (e.g. referring to FIG. 2*e*, this second wavelength converting element light 2101 is generated in the second wavelength converting element 2100 upon excitation by one or more of the first light source light 111, the second light source light 211). This latter option will be elucidated below. In the configuration schematically depicted in FIG. 1*a*, it is clear that the second wavelength converting element 2100 is able to convert light. It is able to do so when illuminated by excitation light. However, in this configuration it will not do so; when changed to another configuration, where the second wavelength converting element 2100 is (also) arranged downstream of the light source(s), then the second wavelength converting element 2100 will convert light. Therefore, "able to convert" is applied. The second wavelength converting element 2100 and the first wavelength converting element 1100 have a spectral distribution different from the first wavelength converting element light 1101.

The luminescent material may typically absorb light in the wavelength range from 400 nm to 500 nm. The luminescent material typical emits light in the wavelength range from 480 nm to 600 nm. In an embodiment we suggest the use of organic phosphors. Examples of suitable organic wavelength converting materials are organic luminescent materials based on perylene derivatives, for example compounds sold under the name Lumogen® by BASF. Examples of suitable compounds that are commercially available include, but are not limited to, Lumogen® Red F305, Lumogen® Orange F240, Lumogen® Yellow F083, and Lumogen® F170, and combinations thereof. Advantageously, an organic luminescent material may be transparent and non-scattering. In another embodiment we suggest the use of quantum dots. Quantum dots (or rods) are small crystals of semiconducting material generally having a width or diameter of only a few nanometers. When excited by incident light, a quantum dot emits light of a color determined by the size and material of the crystal. Light of a particular color can therefore be produced by adapting the size of the dots. Most known quantum dots with emission in the visible range are based on cadmium selenide (CdSe) with shell such as cadmium sulfide (CdS) and zinc sulfide (ZnS). Cadmium free quantum dots such as indium phosphide (InP), and copper indium sulfide (CuInS2) and/or silver indium sulfide (AgInS2) can also be used. Quantum dots show very narrow emission band and thus they show saturated colors. Furthermore the emission color can easily be tuned by adapting the size of the quantum dots. Any type of quantum dot known in the art may be used in the present invention. However, it may be preferred for reasons of environmental safety and concern to use cadmium-free quantum dots or at least quantum dots having a very low cadmium content. In another embodiment we suggest the use of inorganic phosphor. The remote phosphor element may also comprise an additional inorganic phosphor. Examples of inorganic phosphor materials include, but are not limited to, cerium (Ce) doped YAG (Y3Al5O12) or LuAG (Lu3Al5O12). Ce doped YAG emits yellowish light, whereas Ce doped LuAG emits yellow-greenish light. Examples of other inorganic phosphors materials which emit red light may include, but are not limited to ECAS and BSSN; ECAS being Ca1-xAlSiN3:Eux wherein $0<x\leq1$, preferably $0<x\leq0.2$; and BSSN being Ba2-x-zMxSi5-yAlyN8-yOy:Euz wherein M represents Sr or Ca, $0\leq x\leq1$, $0\leq y\leq4$, and 5 $0.0005\leq z\leq0.05$, and preferably $0\leq x\leq0.2$). It is also possible to use large stokes shift materials.

Further, the lighting unit 100 comprises a transport infrastructure 20 configured to arrange the first light source 110, the second light source 210, the first wavelength converting element 1100, and the second wavelength converting element 2100 in a first configuration or a second configuration by transport of one or more of these. Here, two configurations could e.g. be obtained when the second wavelength converting element 2100 is slided or rotated to the position the first wavelength converting element 1100 presently has.

As indicated above, in the first configuration and the second configuration the lighting unit provides lighting unit light 101 having substantially the same color point while having different color rendering indices. This can be done by e.g. using a blue first light source, a red second light source, a green emitting first wavelength converting element 1100, a green emitting second wavelength converting element 2100, emitting at another color point in the green, and by arranging the first wavelength converting element 1100 as presently shown—a first configuration—or arranging the second wavelength converting element 2100 at the present position of the first wavelength converting element 1100—in a second configuration—, and where necessary fine tuning the color point by tuning the intensity of one or more of the first and the second light source. Note that optionally also other light sources may be used to fine tune the color point.

Here, the first wavelength converting element 1100 and the second wavelength converting element 2100 may especially be transmissive for light of the first light source and the second light source. This is shown by the arrow of light 111 and the arrow of light 211 downstream of the first wavelength converting element 1100. The lighting unit light 101 will in general be composed of (i) one or more of first wavelength converting element light 1101 and second wavelength converting element light 2101, and (ii) one or more of first light source 110 and second light source 210. However, the relative amounts of the contributions will differ between the first and the second configuration.

FIG. 1*a* schematically depicts a lighting unit comprising a cavity 27, which cavity is formed by a wall 7 and a light exit window 37, which in this instance comprises the first wavelength converting element 1100. The wall 7 may in general comprise a reflective surface 17. For instance, the wall may comprise Teflon or comprise a $TiO_2$, $Al_2O_3$, or $Ba_2SO_4$ coating.

Reference 30 refers to a(n optional) control unit. This control unit 30 may be configured to control the lighting unit, for instance upon a user instruction, arrange the lighting unit 100 in the first or the second configuration (or further configurations, see also below). This control unit 30 may also be applied to control e.g. the intensity of one or more of the first and the second light source, to fine tune the color point of the lighting unit light 101. To this end, the lighting unit may further comprise an optical sensor 40, which may be arranged in or outside the cavity, especially arranged to determine the color point of the lighting unit light 101, and give sensor signal feedback to the control unit for controlling CRI, color point, etc. A(n optional) sensor 50 may also be part of the lighting unit, which sensor may e.g. be configured to measure parameters external from the lighting unit (or luminaire, see also below), for instance rain, fog, etc. Based on such parameters, the control unit 30 may select one of the possible configurations. Note however that it may also be possible that the lighting unit 100 is set in a fixed configuration. For instance, in a production plant the lighting unit 100 may be set in one of the possible configuration when the final application is known.

Hence, in an embodiment, the lighting unit may comprise besides LEDs and a phosphor element a sensor and a driver (actuator of the transport infrastructure). For example, a sensor may detect the presence of a phosphor element and accordingly the controller will control the driver to drive the LED at a specific current needed for producing light of a specific CCT and CRI. In another example, a sensor may detect the CCT and CRI of the light and accordingly the controller will control the driver to drive the LED at a specific current needed for producing light having another specific CCT and CRI. In another example, the sensor is a time sensor or may detect other input (e.g. light intensity, rain, fog, temperature, humidity, . . . ) and accordingly the controller will control the driver to drive the LED at a specific current needed for producing light having another specific CCT and CRI.

Figure 1B:
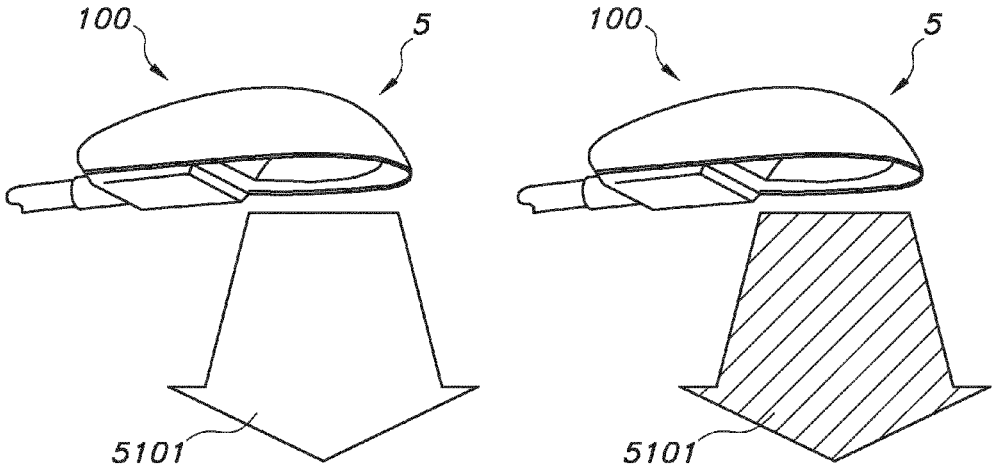
Figure 1C:
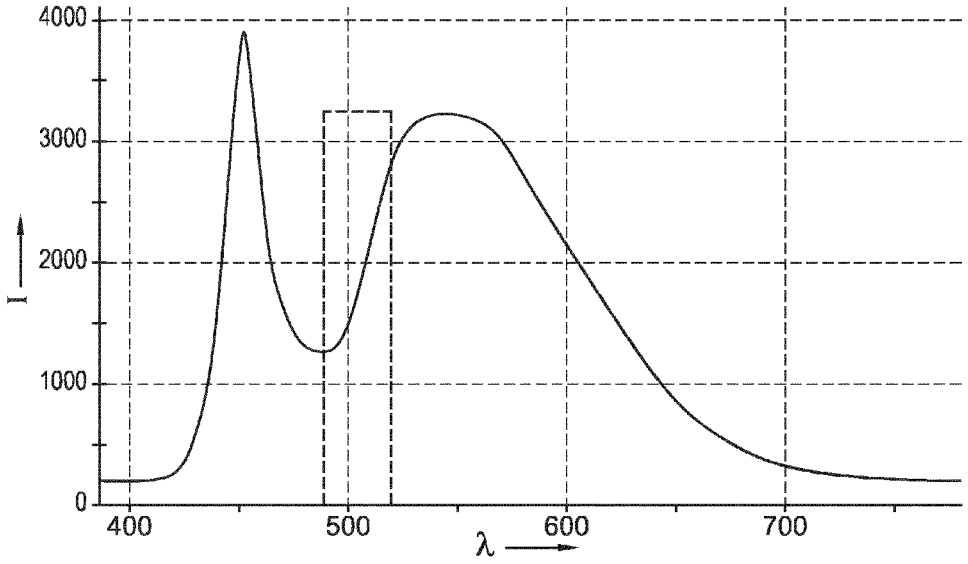

At certain time of the day, it might be desirable to have high Color Rendering Index (CRI) while at other times high efficiency. For example, at 9:00 pm light having a CRI preferably above 80 is desired, while at 01:00 am light with lower CRIs are still suitable while being more efficiently. For this purpose, therefore it is interesting to have a lighting unit 100 or luminaire 5 (comprising such lighting unit 100) which can switch between high CRI-low efficiency and low CRI-high efficiency at a given color temperature, as schematically depicted in FIG. 1*b*. Especially, in order to get to a low CRI lamp it is a dip in the blue-green part of the spectrum may be desirable, see FIG. 1*c*. FIG. 1*c* shows the light distribution of a typical phosphor converted LED light source. Luminaire light is indicated with reference 5101, which may consist of lighting unit light (101) of one or more lighting units as described herein.

In order to have such a configurable lamp we suggest amongst others using Blue and Red LEDs and use a remote/vicinity phosphor for changing the emission position of the green/yellow phosphor and adjust the intensity of the Red LEDs for staying on the black body line at the desired color temperature and just change the emission position of the green emitter, see FIG. 2*a*. Note that in FIG. 2*a*, and similar figures, the first wavelength converting element 1100 and one or more of the first and the second light source are radiationally coupled in the configuration depicted on the left; the second wavelength converting element 2100 and one or more of the first and the second light source are radiationally coupled in the configuration depicted on the right. FIG. 2*b* schematically depicts the first light converting element 1100 being replaced by the second light converting element 2100, thereby creating another configuration. For instance, a phosphor plate/disc can be inserted (by the transport infrastructure).

Note that lighting unit light 101 in general at least comprises one or more of the first and the second wavelength converting element light and in general also at least one or more, especially at least both of the first light source light and the second light source light.

Alternatively or additionally, a light converting element can be arranged downstream (or upstream) of another light converting element as schematically shown in FIG. 2*c*. In this way, a phosphor enhanced lighting device can be provided in which a second phosphor plate/disc can be positioned on top of a first phosphor plate/disc. Assuming that one may arrange either wavelength converting element 1100 (see FIG. 2*c* left), or wavelength converting element 2100 (same as FIG. 2*c* left, but than element 2100 instead of 1100), or both wavelength converting elements (FIG. 2*c* right), then there are three possible configurations. The actuator (not shown), can configure the wavelength converter elements, in the respective configurations. Alternatively or additionally, more than two light converting elements may be applied, see FIG. 2*d*, which opens also the option of providing more than two configurations. Hence, e.g. more than two phosphor plates/discs can be used.

FIGS. 2*c* and 2*d* schematically depict embodiments wherein in one or more configurations stacked wavelength converting elements may be applied. Hence, the transport infrastructure (not depicted) is configured to arrange in a first configuration the first wavelength converting element downstream of the first light source and the second light source and in a second configuration the second wavelength converting element in a (stacked) configuration downstream of the first light source and the second light source. In such embodiments, a wavelength converting element downstream of another wavelength converting element may be configured to absorb part of the wavelength converting element light of the wavelength converting element arranged upstream of such wavelength converting element, such as second wavelength converting element 2100 converting at least part of first wavelength converting element light (not depicted).

Alternatively or additionally, two or more light converting elements may also be arranged next to each other (see also FIG. 1*a*), as e.g. depicted in FIG. 2*e*. Here, by way of example three luminescent converting elements 1100,2100, 3100 are depicted. However, also more than three, or only two, may be applied. By transporting the light sources 110,210 and/or the light converting elements 1100, 2100, . . . , the different configurations may be obtained. Hence, for instance, a phosphor enhanced lighting device may be obtained comprising a movable phosphor element comprising at least two different luminescent areas.

Figure 2F:
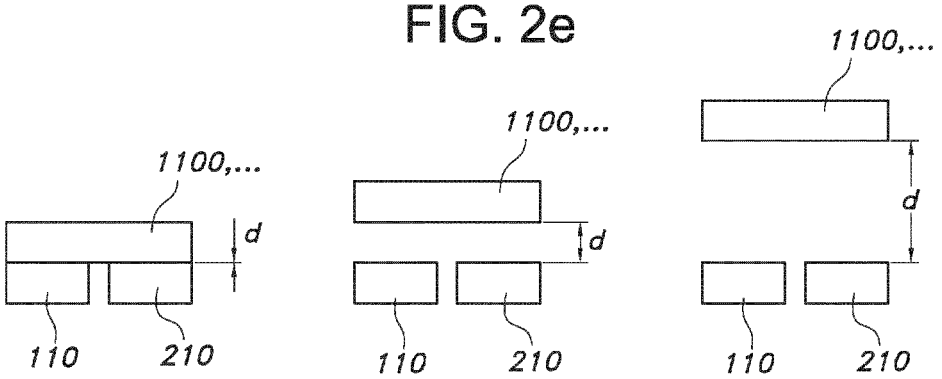

In an embodiment, the light converter is arranged remote from the source of light. Especially, the organic luminescent materials are arranged remote from the LED die (i.e. not in physical contact with the LED). The shortest distance between the source of light (exit surface), such as a LED (die), and one or more of the luminescent materials, preferably all luminescent materials, may be larger than 0 mm, especially equal to or larger than 0.1 mm, such as 0.2 or more, and in some embodiments even equal to or larger than 10 mm, such as 10-100 mm. A remote application may further increase lifetime. However, the present invention also includes applications wherein the light converter is in physical contact with the LED die (or other light source (surface)). At a non-zero distance, but remote from the light source may also be indicated as "in the vicinity". Embodiments are schematically shown in FIG. 2*f*, with d indicating the distance between the light source(s) and the light converting elements. Assuming an LED as light source, especially the distance d is the distance between the LED die and the light converting element(s).

Figure 3:
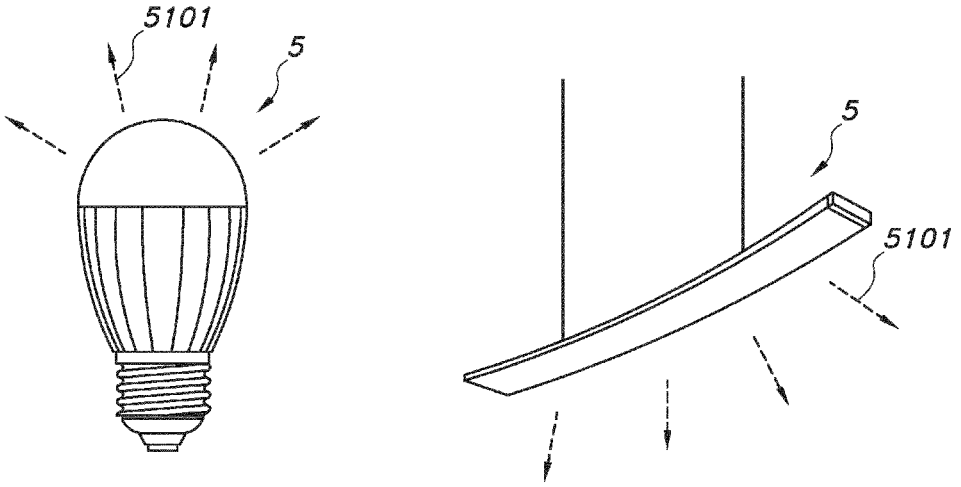
FIG. 3 schematically depicts some embodiments of a luminaire.

FIG. 3 (but also FIG. 1*b*) schematically depicts embodiments of a lamp (left) and a luminaire (right) that may comprise one or more lighting units 100 as described herein.

Figure 4D:
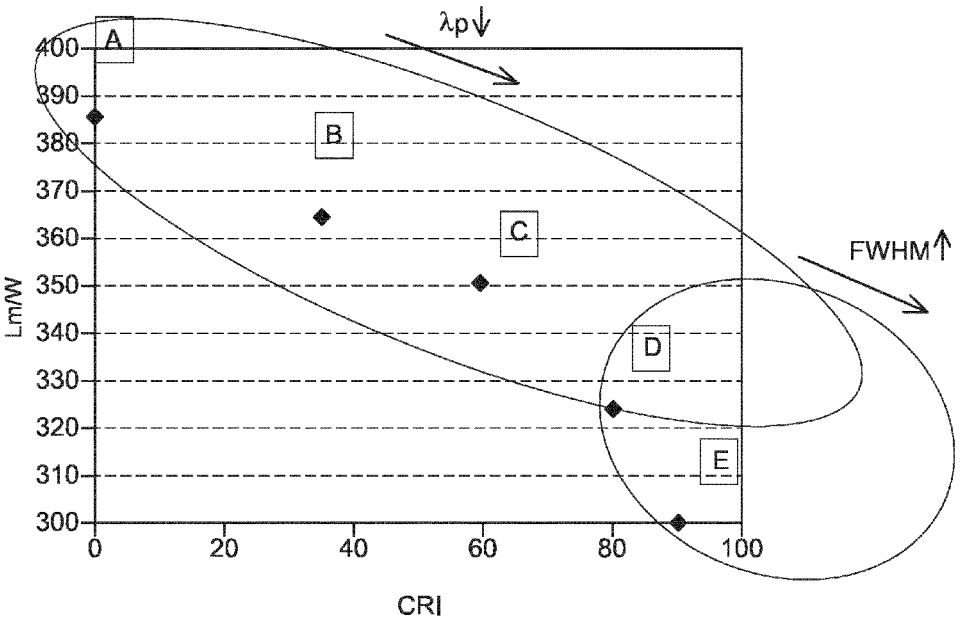

FIGS. 4*a*-4*c* show three out of a set of five configurations, each providing the same color point (color temperature), about (0.8,0.8) but each configuration having a different CRI and efficiency (as shown in FIG. 4*d*). The CRI, on the x-axis in FIG. 4*d*, increases with decreasing efficiency; the peak maximum (λp) decreases from left to right and the full width half maximum (FWHM) decreases from left to right, with the exception of point D and in particular point E, with the latter having an FWHM of 88 nm. An blue LED is used which emits light having a λpeak (λp) at 450 nm, and a red LED is used which emits light having a λpeak at 610 nm (see graphs). The λpeak and FWHM of the emission of the phosphor are indicated in the below table. The points A-E indicate the following variation in the light source with intermediate wavelength:

| | Points in FIG. 4d | | | | |
|---|---|---|---|---|---|
| | A | B | C | D | E |
| Peak maximum (λp) [nm] | 575 | 560 | 550 | 545 | 540 |
| Full width half maximum [nm](FWHM) | 35 | 35 | 32 | 39 | 88 |

Hence, the invention may provide a phosphor-enhanced lighting device comprising: a first light source emitting first light source light having a first wavelength distribution, a second light source emitting second light source light having a second wavelength distribution, a first light converting element comprising a first luminescent material, the first luminescent material absorbs first light source light of a first wavelength distribution, and emits first converted light source light having a third wavelength distribution, insertion of a second light converting element and/or replacing the first light conversion with a second light converting element comprising a second luminescent material, the second luminescent material absorbs first light source light of a first wavelength distribution, and emits second converted light source light having a fourth wavelength distribution, accompanied by adjusting the intensity of the second light source having a second wavelength distribution for adapting the color rendering index, wherein when switching from a first color rendering index to a second color rendering index the correlated color temperature of the light emitted from the phosphor enhanced lighting device is maintained over time.

FIG. 5*a* depicts emission spectra of different phosphors (P1, P2 and P3) all in the green-orange part of the spectrum. FIGS. 5*b*-5*d* show different emission spectra of different combinations of light sources and these luminescent materials, all leading to the same color point. For the spectra Philips Lumileds royal blue LED with a wall plug efficiency of 70% and red LEDs with efficacy of 130 lm/W (electrical) were used. We used a Eu2+ containing silicate phosphor P1 and two different Ce3+ containing YAG phosphors P2 and P3. In FIG. 5*a* the emission spectra of the phosphors are shown.

In FIG. 5*b* a spectrum is obtained with a P2 giving an efficacy of 194 Lm/W (electrical) at a CRI of 71. In FIG. 5*c* a spectrum is obtained with P1 giving a efficacy of 180 Lm/W (electrical) at a CRI of 85. In FIG. 5*d* a spectrum is obtained with the YAG phosphor P3 giving an efficacy of 147 Lm/W (electrical) at a CRI of 92. Hence, with the same color point, the efficacy can be varied between 147 Lm/W with a CRI of 92 and 194 Lm/W with a CRI of 71, in the three configurations provided. Such three configuration can be provided e.g. with three wavelength converting element light comprising the respective luminescent materials P1, P2 and P3.

The invention claimed is:

1. A lighting unit comprising:

a first light source configured to generate first light source light, a second light source configured to generate second light source light having a spectral distribution different from the first light source light, a first wavelength converting element able to convert at least part of one or more of the first light source light and the second light source light into first wavelength converting element light, a second wavelength converting element able to convert at least part of one or more of the first light source light, the second light source light, and the first wavelength converting element light into second wavelength converting element light having a spectral distribution different from the first wavelength converting element light, wherein the lighting unit further comprises a transport infrastructure configured to arrange the first light source, the second light source, the first wavelength converting element, and the second wavelength converting element in a first configuration or a second configuration by transport of one or more of these, wherein in the first configuration and the second configuration the lighting unit provides lighting unit light having substantially the same color point while having different color rendering indices.

2. The lighting unit according to claim 1, wherein the first light source comprises a blue emitting light source, wherein the second light source comprises a red emitting light source, wherein the first wavelength converting element and the second wavelength converting element each independently comprise one or more of a green luminescent material, a yellow luminescent material and an orange luminescent material.

3. The lighting unit according to claim 2, wherein the first light source and the second light source are independently selected from the group consisting of a LED and a laser, and wherein the one or more luminescent materials are selected from the group consisting of quantum dot luminescent materials, inorganic luminescent materials and organic luminescent materials.

4. The lighting unit according to claim 1, wherein one or more of the first light source and the second light source have a tunable light intensity, and wherein the lighting unit receives a control signal from a control unit configured to control tunable light intensity of the one or more of the first light source and the second light source having a tunable light intensity as function of the first and the second configuration.

5. The lighting unit according to claim 1, wherein in the first configuration and in the second configuration the lighting unit provides lighting unit light having color points within 15 SDCM (standard deviation of color matching) of each other.

6. The lighting unit according to claim 1, wherein in one or more of the first configuration and the second configuration one or more of the first wavelength converting element and the second wavelength converting element are arranged in a transmissive mode.

7. The lighting unit according to claim 1, wherein the transport infrastructure is configured to arrange in the first configuration the first wavelength converting element downstream of the first light source and the second light source and in the second configuration the first wavelength converting element and the second wavelength converting element in a stacked configuration downstream of the first light source and the second light source.

8. The lighting unit according to claim 1, wherein the transport infrastructure is configured to arrange in a first configuration the first wavelength converting element downstream of the first light source and the second light source and in a second configuration the second wavelength converting element in a stacked configuration downstream of the first light source and the second light source.

9. The lighting unit according to claim 1, comprising a plurality wavelength converting elements, wherein the transport infrastructure is configured to arrange the first light source, the second light source and the plurality of wavelength converting element in a plurality of configurations, by transport of one or more of these, wherein at least in the first configuration and the second configuration the lighting unit provides lighting unit light having substantially the same color point while having different color rendering indices.

10. The lighting unit according to claim 1, further comprising a sensor configured to sense a condition external from the lighting unit, wherein the lighting unit further comprises a control unit configured to control the lighting unit light as function of a sensor signal of the sensor.

11. The lighting unit according to claim 1, wherein the transport infrastructure comprises an actuator.

12. A luminaire comprising the lighting unit according to claim 1.

13. A method for providing white light that has a controllable color rendering index using the lighting unit of claim 1, the method comprising:

arranging the first wavelength converting element in the first configuration; and arranging the second wavelength converting element in the second configuration.

14. The method of claim 13, further comprising controlling, using a control unit, the tunable light intensity of the one or more of the first light source and the second light source having a tunable light intensity as function of the first and the second configuration.

15. The method of claim 14, further comprising controlling the lighting unit in the first configuration and in the second configuration the lighting unit to provide lighting unit light having color points within 15 SDCM (standard deviation of color matching) of each other.

16. The method of claim 13, further comprising arranging in the first configuration the first wavelength converting element downstream of the first light source and the second light source; and arranging in the second configuration the first wavelength converting element and the second wavelength converting element in a stacked configuration downstream of the first light source and the second light source.

17. The method of claim 13, wherein the lighting unit is further comprising a plurality wavelength converting elements, the method further comprising arranging the first light source, the second light source and the plurality of wavelength converting element using the transport infrastructure in a plurality of configurations, wherein at least in the first configuration and the second configuration the lighting unit provides lighting unit light having substantially the same color point while having different color rendering indices.

18. A lighting system comprising:

the lighting unit according to claim 1, a control unit configured to control tunable light intensity of the one or more of the first light source and the second light source having a tunable light intensity as function of the first and the second configuration; and an optical sensor, wherein the control unit is configured to control the tunable light intensity of the one or more of the first light source and the second light source having a tunable light intensity as function of a sensor signal of the optical sensor.

* * * * *